United States Patent [19]

Buell

[11] Patent Number: 5,060,725

[45] Date of Patent: Oct. 29, 1991

[54] HIGH PRESSURE WELL PERFORATION CLEANING

[75] Inventor: R. Scot Buell, Coalinga, Calif.

[73] Assignee: Chevron Research and Technology Company, San Francisco, Calif.

[21] Appl. No.: 454,107

[22] Filed: Dec. 20, 1989

[51] Int. Cl.[5] ..... E21B 37/08

[52] U.S. Cl. ..... 166/222; 166/242; 166/312

[58] Field of Search ..... 166/222, 223, 311, 312, 166/242, 902; 239/550

[56] References Cited

U.S. PATENT DOCUMENTS

| | | | |
|---|---|---|---|
| Re. 31,495 | 1/1984 | Zublin | 166/312 |
| 3,811,499 | 5/1974 | Hutchison | 166/67 |
| 3,850,241 | 11/1974 | Hutchison | 239/550 |

*Primary Examiner*—Terry Lee Melius

*Attorney, Agent, or Firm*—Edward J. Keeling; Matt W. Carson

[57] ABSTRACT

Improved method and apparatus for directionally applying high pressure jets to well casing or liners to clean openings in the casing, liner and the adjacent geologic formation which are plugged with foreign matter. High velocity jets of liquid having a velocity in excess of 700 feet per second are jetted from jet orifices having a 1/16th to ¼th inch diameter and having a standoff distance between 5 and 100 diameters of the orifice from the openings to remove substantially all plugging material from the openings. Power swivels permit rotation and Kelly hoses allow reciprocation of the jet tool and tubing string while maintaining high pressure in the apparatus.

2 Claims, 3 Drawing Sheets

HIGH PRESSURE WELL PERFORATION CLEANING

FIELD OF THE INVENTION

This invention relates generally to well production. More specifically, the invention relates to cleaning openings in both the well casing or liners positioned adjacent fluid-producing formations, and the corresponding openings in the geologic formation itself, using high velocity liquid jets.

BACKGROUND OF THE INVENTION

The production of oil, gas, water, or any combination of these three are produced from wells penetrating the earth's subsurface strata. The wells are most often completed with casing (and liners) cemented through to the productive strata in the subsurface. Wells are also occasionally completed with uncemented liners. In either case, perforations or slots must be made through the casing and cement (if present) to provide a flow path for fluids from the productive strata into the casing. Fluids which have reached the inside of the casing via the perforations or slots may then be produced to the surface. However, the openings which, for example, may be slots in the liner preformed on the surface and/or perforations opened in the casing and formation, will often become plugged.

If a perforation tunnel in the casing, cement sheath, or formation becomes obstructed, then fluid flow will cease or will be impaired. This problem is especially serious in areas where hard, insoluble scales plug perforations. In any event, removal and replacement of the casing or liner is costly and is only a temporary solution since the casing or liner, as well as the adjacent formation, will eventually again become plugged.

Sections of recovered plugged casing and liner have been analyzed to determine the identity of the plugging material. Results have shown that the plugging material is mostly inorganic. Generally, it appears to be fine sand grains cemented together with oxides, sulfides and carbonates. Some asphaltenes and waxes are also present. Where water is produced, scale also seems to be present and presents a very tough plugging material. Examples of scale include barium sulfate, strontium sulfate, and silicates.

Many methods for cleaning openings in well casing or liners have been heretofore suggested. There have been three general methods employed which may be classified as 1) mechanical, 2) chemical, and 3) hydraulic.

Mechanical methods can be thought of as using physical force to scrape an obstruction from the perforation tunnel. There are no prior art mechanical means to effectively clean perforations. Mechanical methods at this time are limited to cleaning inside the casing, which does not address the perforation itself. The only mechanical alternative to deal with obstructed perforations is to drill and complete a new wellbore, which is usually economically unattractive.

Mechanical methods of cleaning the openings in casing or liners include the use of scratchers and brushes to cut, scrape or gouge the plugging material from the perforations. There are many disadvantages of these approaches. For example, the knives or wires in the brushes must be very thin to enter the slotted perforations which generally measures only 0.040 to 0.100 inches wide and, therefore, the knives and wires are structurally weak. Thus, an insufficient amount of energy is generally applied to really unclog the perforations. Furthermore, the cleaning tool must be indexed so that the knives or wires actually hit a perforation. Since only 3% of the casing or liner surface area is generally perforated, the chances are not favorable for contacting a perforation.

Chemical methods usually consist of using some chemical agent to dissolve or dislodge obstructions in the perforation tunnel. Common chemicals used to remove obstruction are acids, aromatic solvents, alcohols, and surfactants. These chemicals have been found to be very effective at removing a wide variety of obstructions in and around perforation tunnels. The chemical methods require that the obstruction be chemically reactive with the chemicals placed in the perforation tunnels. However, there are a number of substances which are essentially non-reactive and inert for all practical purposes. Some common examples of these relatively inert obstructions are barium sulfate, strontium sulfate, and silicates. These substances are frequently deposited as scales. The deposition of these scales in and around perforation tunnels can obstruct or impede fluid flow.

Chemical solvents have been developed which purport to dissolve these non-reactive substances. These solvents have been evaluated in the laboratory and in field trials, and have been found to be very ineffective. The chemical solvents were found to dissolve such a small amount of these non-reactive substances that they are economically unattractive.

The combinations of plugging materials often inhibits the reaction of the chemicals. For example, an oil film will prevent an acid from dissolving a scale deposit and a scale deposit will prevent a solvent from being effective in dissolving heavy hydrocarbons. The chemicals cannot always be selectively placed where they are needed due to varying permeabilities encountered in a well bore and/or they dissolve the material in a few perforations and then the chemicals are lost into the formation where they can no longer be effective in cleaning the perforations.

Hydraulic methods include pumping a fluid between two or more opposed washer cups until the pressure builds up sufficiently to hydraulically dislodge the plugging material. Explosives such as primer cord (string shooting) have been used to form a high energy pressure shock wave to hydraulically or pneumatically blow the plugging material from the perforations. The disadvantages of these two methods are that the energy is applied non-directionally to the casing or liner and it always takes the path of least resistance. The use of these methods generally results in opening only one or two perforations out of a perforation row containing from 16 to 32 perforations.

Jetted streams of liquid have also been heretofore used to clean openings. The use of jets was first introduced in 1938 to directionally deliver acid to dissolve carbonate deposits. Relatively low velocities were used to deliver the jets. However, this delivery method did improve the results of acidizing. In about 1958 the development of tungsten carbide jets permitted including abrasive material in a liquid which improved the ability of a fluid jet to do useful work. The major use of abrasive jetting has been to cut notches in formations and to cut and perforate casing to assist in the initiation of hydraulically fracturing a formation. The abrasive jetting method requires a large diameter jet orifice. This large opening required a large hydraulic power source in order to do effective work. The use of abrasives in the jet stream permitted effective work to be done with available hydraulic pumping equipment normally used for cementing oil wells. However, the inclusion of abrasive material in a jet stream was found to be an ineffective perforation cleaning method for use with liners in that it enlarged the perforation which destroyed the perforation's sand screening capability. A jet that uses abrasives also is likely to cause casing damage.

Another method for directionally applying a high pressure jet to a well liner to clean openings in the liner which are plugged with foreign matter has been suggested. High pressure liquid jets having a velocity in excess of 700 feet per second are jetted at the liner from jet orifices having a standoff distance less than 10 times the diameter of the orifice to remove plugging material from the liner openings. An apparatus for concurrently circulating foam is provided in combination with the apparatus used to deliver the high pressure, high velocity jets, due to the relatively low circulation rate.

Relatively small diameter, threadably attached orifices which produce jets of 1/16th of an inch or less were thought to be advantageous in this method. A preferred orifice diameter for use in accordance with the method was 1/32nd of an inch. The use of small diameter threadably attached jets was thought to be very advantageous in that liquid volume requirements are lowered, thus lowering horsepower requirements and reducing the possibility of formation damage in low pressure formations caused by liquid in the well overpowering the formation. For example, see U.S. Pat. Nos. 3,850,241; 4,088,191; 3,720,264; 3,811,499; and 3,829,134; each of which issued to S. O. Hutchison. Whereas Hutchison's invention was a substantial improvement over the prior art at the time regarding cleaning perforations in a casing or liner, his method did not provide a means to clean out the perforations in the geologic formation itself, adjacent to the perforations in the casing or liner, or to adequately remove insoluble scale. The cleaning radius of Hutchison's tool is limited by the small nozzles used (1/32nd of an inch). The retained energy of jets is a function of the number of nozzle diameters from the point of origin. Using water (without chemical additives) the effective cleaning range of a nozzle is typically taken as 10 nozzle diameters due to energy decay. This results in effective cleaning radius of up to 5/16ths of an inch for a 1/32nd of an inch nozzle.

The addition of high molecular weight polymers results in enhanced jet performance. The effective cleaning range of a nozzle can be extended out to 100 nozzle diameters. The Hutchison tool with the use of polymer would then have a cleaning radius of up to 3⅛ inches. Typical perforations, usually extend from 3/16 of an inch out to 15 inches radially from the nozzle. Thus, the Hutchison tool can only clean a small fraction of the perforation tunnel, and fluid flow remains greatly impaired.

Using larger nozzles, in the range of 1/16th to ¼ inch, larger cleaning radii can be obtained. For the case of 1/8th inch nozzles, the effective cleaning radius can be increased four fold over Hutchison's tool to 12½ inches. This larger cleaning radius results in more of the perforation being cleaned, and hence improved fluid flow.

Hutchison, as well as the other prior art, actually taught away from using larger nozzles in an effort to clean the perforations in casing. Hutchison maintained that the use of relatively smaller diameter jet orifices of less than ⅛ inch has the advantage of reducing to a minimum the amount of liquid being injected into the well, as well as reducing horsepower requirements. Also, Hutchison incorporated threadably attached, specially designed jet nozzles and made no mention of nozzles being attachable by 0-rings.

A further attempt to improve the existing methods was made by C W. Zublin. Zublin, a licensee of the Hutchison patents, received U.S. Pat. Nos. 31,495; 4,441,557; 4,442,899; and 4,518,041. U.S. Pat. No. 31,495 added a centralizer to help center the jet nozzles and provide a means to pan out of tight places in the tubing. This device is rotated by a power swivel at the surface. Zublin, however, maintained that larger nozzles are disadvantageous in that they cause a pressure drop, and recommended that the jet orifices be only 0.03 (1/32) inch in diameter. Zublin also only taught the use of threadably mounted nozzles.

U.S. Pat. No. 4,441,557 claims nozzles spaced so as to direct cleaning fluid onto the pipe in a certain pattern. The device is rotated at a constant speed by the power swivel at the surface. Again, 0.03 (1/32)-inch threadably mounted nozzles were used, as larger nozzles were said to cause a pressure drop.

U.S. Pat. No. 4,442,899 claims a method and a system for a non-rotating device utilizing threadably mounted 0.0325 (1/32-inch) nozzles and alternating pressure to create an oscillating twisting force according to a certain formula, for use with coiled tubing.

U.S. Pat. No. 4,518,041 claims a method and a system utilizing a device that is not rotated by the tubing at the surface. The device has threadably mounted 0.0325 (1/32-inch) nozzles which, like the device in U.S. Pat. No. 4,442,899 direct the flow of the cleaning fluid in such a manner as to tend to twist the tubing.

A further attempt to improve the well cleaning process was made by Wm. H. McCormick, who received U.S. Pat. No. 4,625,799. U.S. Pat. No. 4,625,799 claims an apparatus for pressurized cleaning of flow conductors. The device utilizes a control slot which assists in indexingly rotating the nozzle section. Neither nozzle size nor means of nozzle attached are discussed.

The above methods and devices are all limited in the effective cleaning distance of the jets, to a distance of up to 10 times the diameter of the jet orifice. Also, none of the prior art teaches a method of how to remove insoluble scale, such as barium sulfate, strontium sulfate, or silicate. This limitation prevents actual cleaning of the perforation tunnels in the adjacent production geologic formation, which often become plugged and therefore inhibit oil or gas production. There is, therefore, still a need for a method of cleaning openings both in a well casing or liner and in the adjacent geologic formation which is a practical and relatively easy operation to perform. Further, there is need for a method of cleaning openings in such casings, liners, and geologic formations which does not destroy or alter the openings or damage the casing or liner.

The above methods and devices are also limited in that the nozzles must be specially designed to be threadably attached to the cleaning tool. Constructing the individual nozzles is relatively expensive. There is therefore still a need for a method of attaching readily available, relatively inexpensive nozzles to the cleaning tool.

SUMMARY OF THE INVENTION

An apparatus for jet washing perforation tunnels in a well casing or liner positioned in a well and perforation tunnels in an adjacent geologic formation is described. A tubing means forms a well flow path from the earth's surface to a location adjacent to the well liner. A source of high pressure liquid provides a hydraulic horsepower of at least 1,000 HHP (or 167 HHP per jet body of ⅛-inch nozzle diameter) to supply at least 0.77 barrels per minute per jet body used at pressures in excess of 5,000 psi to jet the liquid at the liner. The effective standoff distance of cleaning is up to 100 times the diameter of the jet orifice, provided that a polymer additive is added to the high pressure liquid. The effective standoff distance of cleaning is up to 12 times the diameter if plain water is used.

A conduit connects the liquid source to the tubing means. A jet tool means having at least one hole in the wall jets the high pressure liquid at the perforation tunnels in the casing or liner. The jet tool comprises a tubular member connected to the lower end of the tubing means.

A jet seat is fixedly connected to the tubular member, and has a central opening aligned with the hole in the jet tool wall. A jet body, having a central opening of 1/16th to ¼th inch in diameter is hydraulically sealed in the jet seat member, so that the jet body can be rotated to provide axial movement with respect to the jet seat member.

In another embodiment, a jet tool means has a hole in the sidewall for jetting the high pressure liquid at the perforation tunnels. A jet seat member is fixedly connected to the tubular member, and has a central opening positioned over the hole. The tubular member is connected to the jet seat member and a jet body, having a central opening of approximately 1/16th to ¼th inch in diameter is detachably engaged and hydraulically sealed in the jet seat member so that the jet body may be rotated to cause axial movement of the jet body with respect to the jet seat member.

The use of the jet bodies (or nozzles) having relatively large central opening is very advantageous and novel. If a ⅛ inch nozzle diameter is used, the effective cleaning radius of the apparatus is increased to approximately 12.5 inches or 100 nozzle diameters if a polymer additive is used, or 1.5 inches or 12 nozzle diameters if plain water is used. The effective cleaning radius of 100 diameters corresponds to an 80% energy loss. The same is true for the effective cleaning radius of 12 diameters, if plain water is used. This larger sized jet body opening permits actual cleaning of the perforation tunnels in the adjacent geologic formation as well, whereas the prior art was limited to a far shorter cleaning radius. Also, the larger sized jet body openings permit the removal of insoluble scale, such as barium sulfate, strontium sulfate, or silicate. Current technology now provides an economic source of high pressure liquid that is able to provide a hydraulic horsepower of at least 1,000 HHP (167 HHP per nozzle) for supplying liquid at a flow rate of at least 4.6 barrels per minute, if 6 nozzles are incorporated (or 0.77 barrels per minute per nozzle) at pressures in excess of 5,000 psi. For example, pump trucks are widely used in routine downhole fracturing of a potentially productive geologic formation, and are able to generate the needed hydraulic horsepower described above.

DETAILED DESCRIPTION OF THE INVENTION

Figure 1:
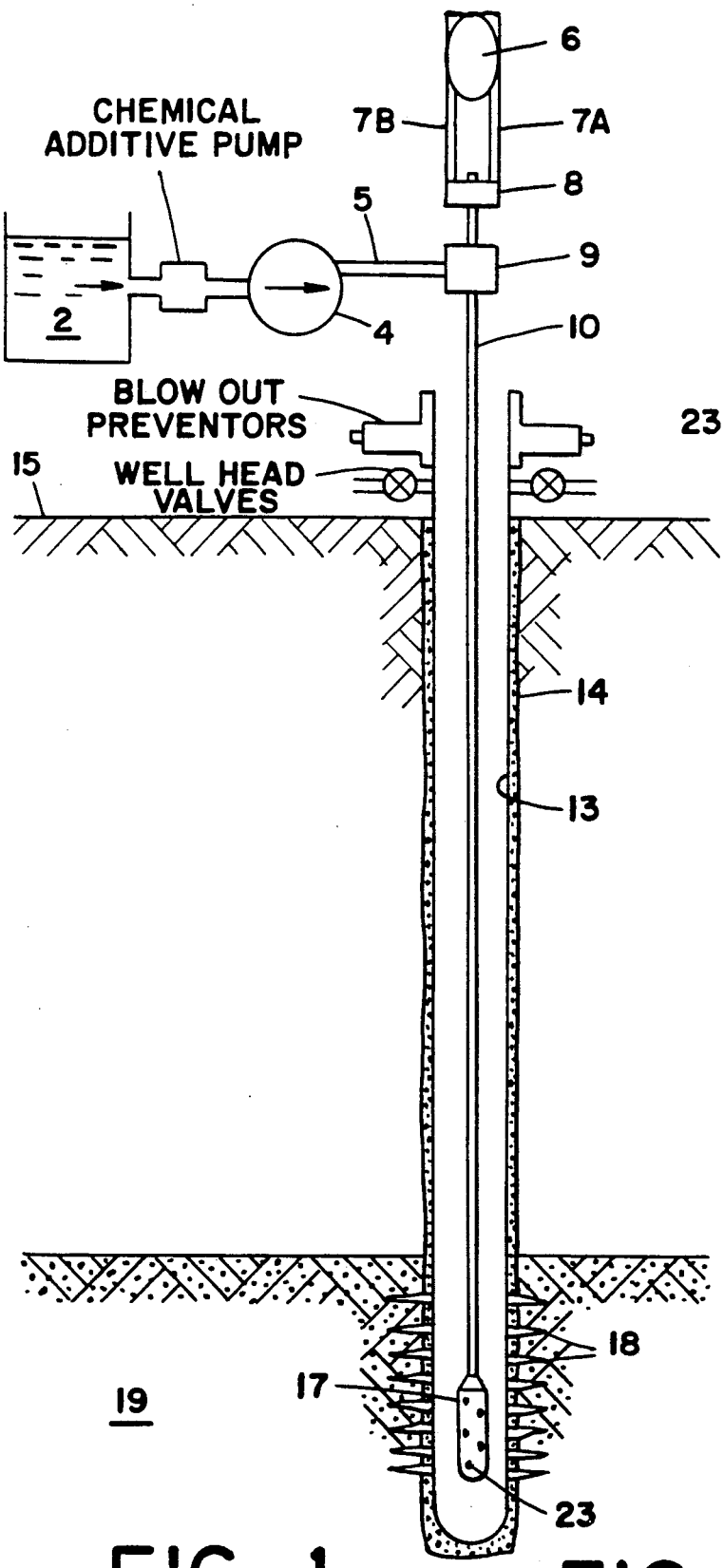
FIG. 1 is an elevation view, partially in section, illustrating the preferred embodiment of apparatus assembled in accordance with the present invention positioned in a well casing.
Figure 2:
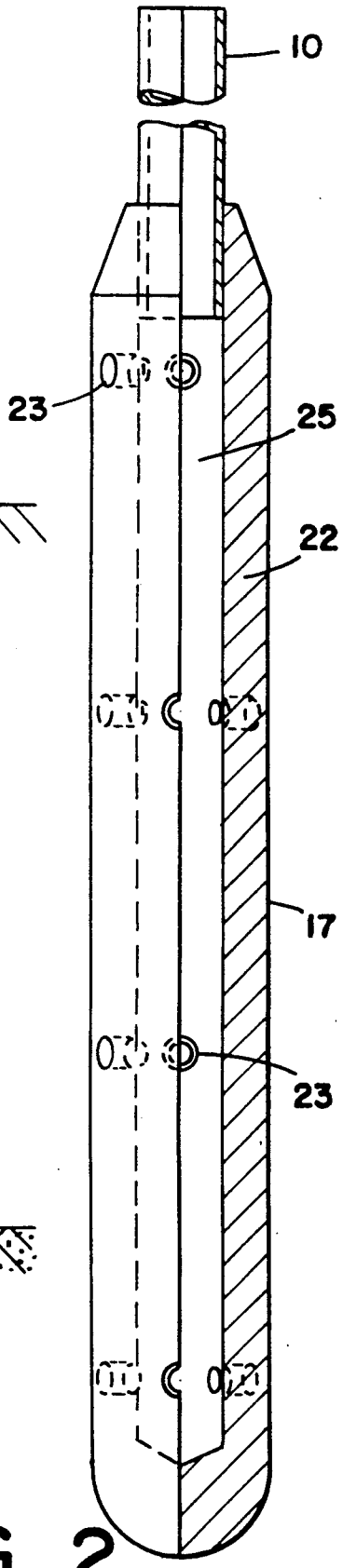
FIG. 2 is a sectional view and illustrates the jet tool of the preferred embodiment of apparatus.
Figure 3:
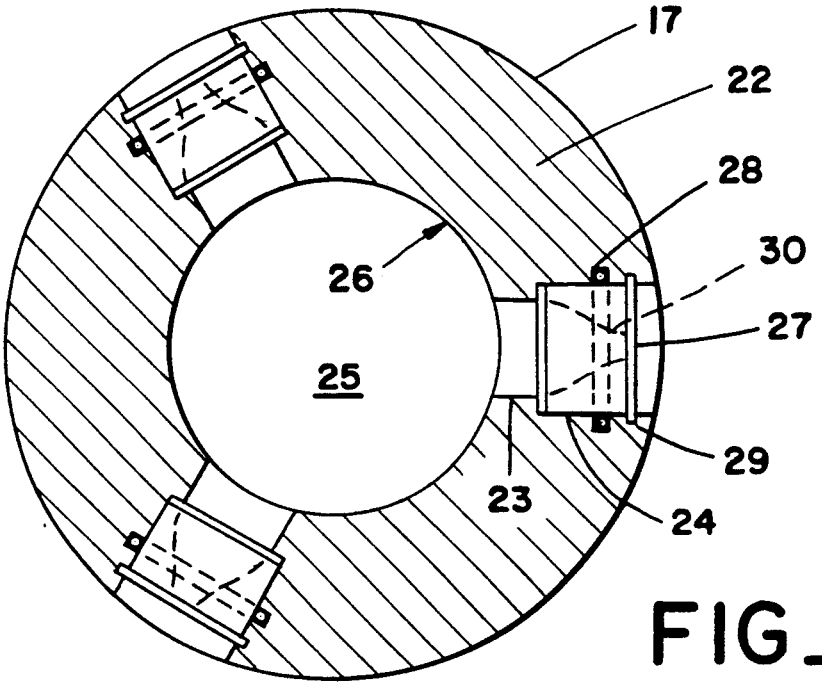
FIG. 3 is view taken at line 10A—10A of FIG. 2.
Figure 4:
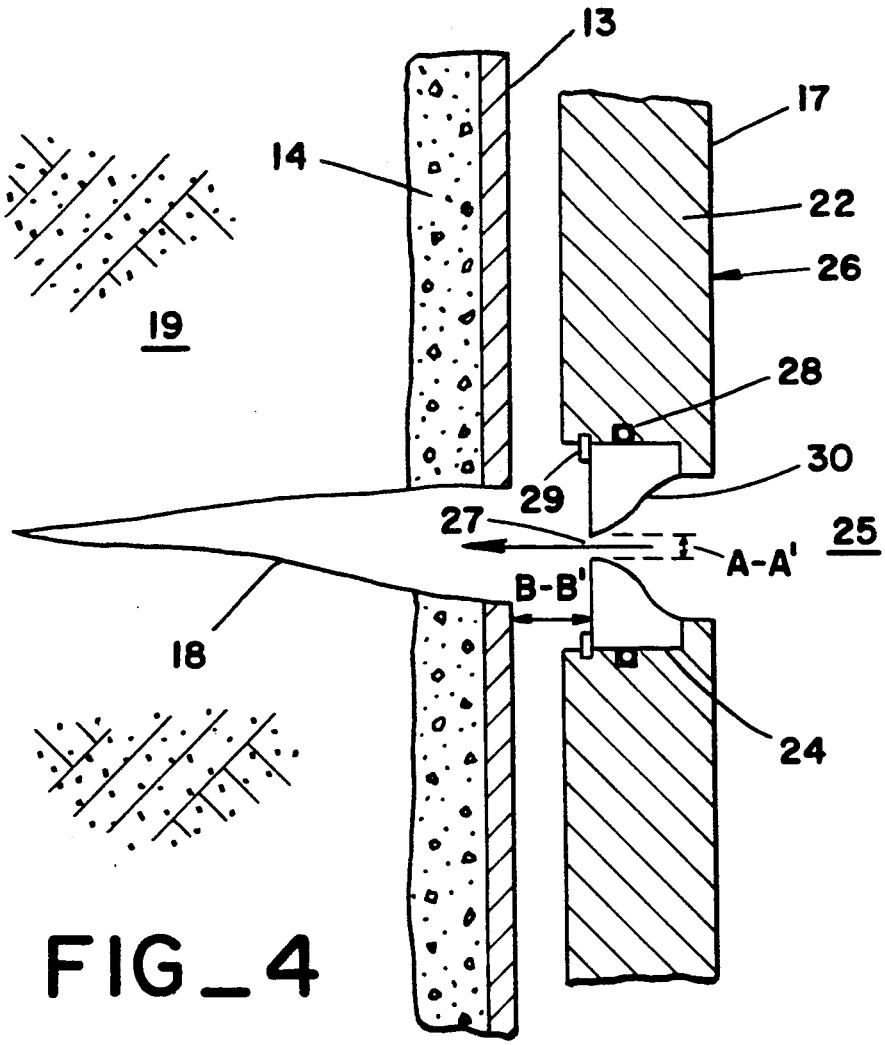
FIG. 4 is a detail view of the jet body and a well liner showing standoff distance in accordance with the present invention.

FIG. 1 is an elevation view, partially in section, and illustrates the preferred embodiment of apparatus assembled in accordance with the present invention positioned in a well. FIGS. 1 and IA thus illustrate the overall view of the preferred apparatus of the present invention. FIGS. 2 through 4 illustrate portions of the preferred apparatus in greater detail.

Figure 1A:
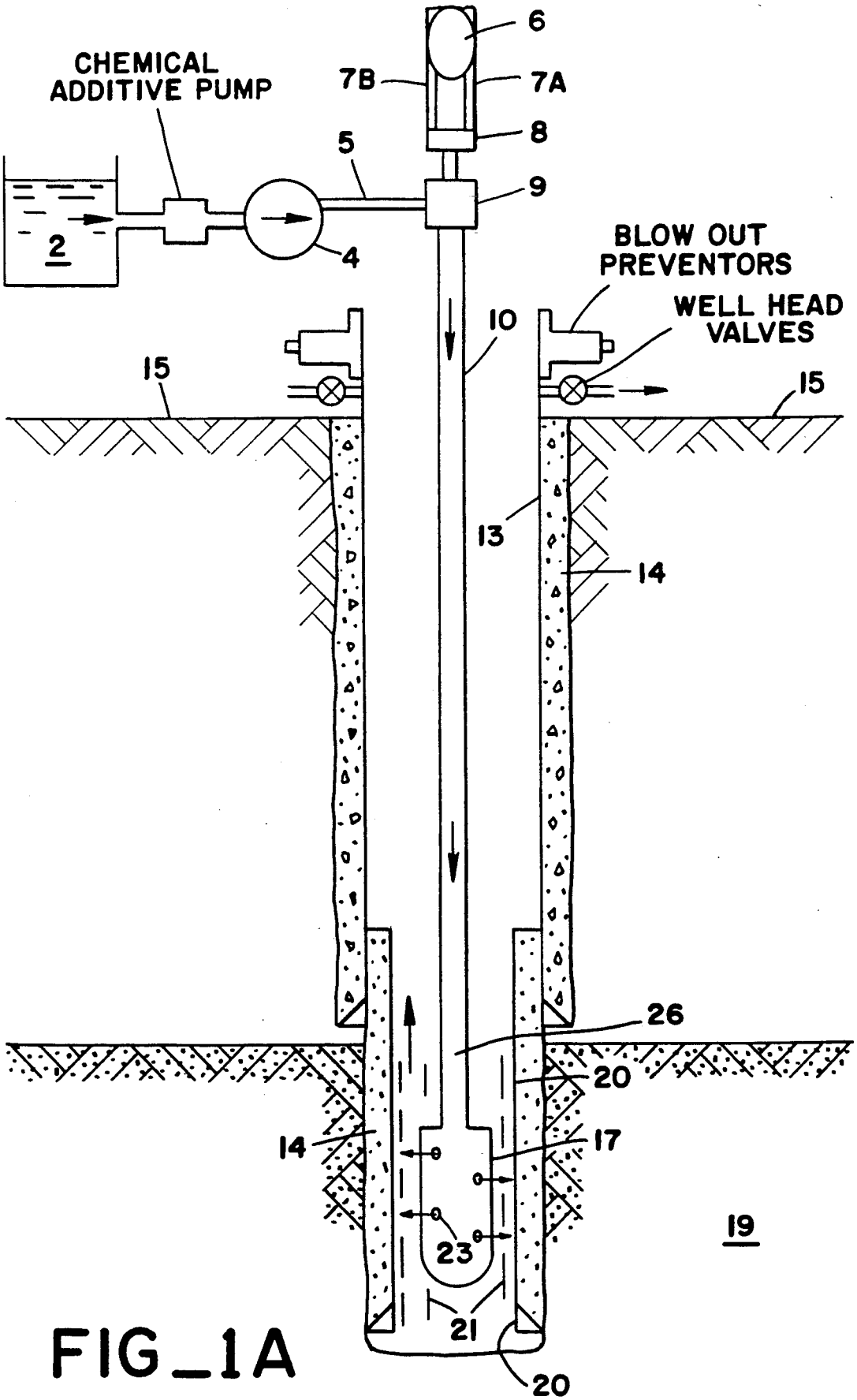
FIG. 1*a*) is an elevation view, partially in section, illustrating the preferred embodiment of apparatus assembled in accordance with the present invention positioned in a well liner.

In FIG. 1 a production or injection well is shown drilled into a fluid producing formation 19 from the earth's surface 15. The well is cased with a suitable string of casing 13 through the productive or injective interval 19. FIG. 1(A) is an elevation view, partially in section, illustrating the preferred embodiment of apparatus assembled in accordance with the present invention positioned in a well liner. Note that the tool can be utilized equally well for a well liner. A liner 20 having suitable openings 21 is hung from the casing 13 and extends along the producing formation 19.

The openings which may be slots or perforations permit flow of formation fluids from formation 19 into the interior of the well. As the formation fluids are produced, the openings in both the slotted liner 21 (or a casing 18) and the adjacent formation 19 tend to become plugged by depositions of scale, asphalt, clay and sand. The plugging material in the various slots or perforations at different elevations in the liner 20 (or casing 18), cement sheath 14, or formation 19 will vary in composition and, depending on the composition, will be more or less difficult to remove in order to reopen the slots. As the slots or perforations become plugged production from the well will tend to decline. Once it has been determined that the openings in the well casing 18, cement sheath 14 or liner 21 or formation 19 have become plugged to the extent that cleaning is required for best operation of the well, the apparatus shown in FIG. 1 is assembled to accomplish such cleaning.

The present invention utilizes high velocity jets 23 of liquid 2 to clean plugged openings (or perforation tunnels) both in well casings and liners, liners and in the adjacent geologic formation. The high kinetic energy of the jet is directionally applied to the openings by means of a rotatable and reciprocal jetting apparatus. Thus, the apparatus of the present invention can be rotated while jetting high pressure liquid jets 23 at the casing or liner. Additionally, the present apparatus may be concurrently raised or lowered in the well to provide for overall coverage of the liner by the jetted liquid.

The use of high velocity jets 23, i.e., having pressures in excess of 5,000 psi, permits maximum energy release to clean the openings of a liner or in a formation. Only three to nine jets are incorporated, so there is no pressure drop or extra volume of liquid required. To increase the jet nozzle (or jet body) size from 1/32nd inch diameter, (taught by the prior art) to the novel recommended size of 1/16th to ¼th inch diameter, the number of nozzles has to be reduced from about 14 to no more than 9 to avoid an excessive loss of pressure. The cleaning radius of the tool increases from 3.1 inches using a polymer or 0.38 inches if plain water was used for a 1/32-inch nozzle, to approximately 12.5 inches or 100 nozzle diameters for a ⅛-inch nozzle if a polymer additive is used, or 1.5 inches or 12 nozzle diameters if plain water is used. The effective cleaning radius of 100 diameters corresponds to an 80% energy loss. The same is true for the effective cleaning radius of 12 diameters, if plain water is used. The hydraulic horsepower must also be increased about eight-fold from 125 HHP (9 HHP per nozzle) with a 1/32-inch nozzle to 1,000 HHP (167 HHP per nozzle) with a ⅛-inch nozzle. Typical service company pump trucks generally have this much hydraulic horsepower available. As a flow rate in excess of 4.6 barrels per minute if 6 nozzles are incorporated (or 0.77 barrels per minute per nozzle) is utilized, the flow rate is sufficient to clean the dislodged material from the well.

In accordance with the invention, a method of jet cleaning a well casing or liner is provided by flowing high pressure liquid down a flow path from the earth's surface to a point adjacent the plugged openings in the casing or liner. A jet of liquid is formed by passing the liquid through a small diameter jet orifice from 1/16th to ¼th inch in diameter at a velocity of at least 700 feet per second and directing the jet of liquid at the casing or liner to clean the slots or perforations thereof from a distance of between 5 and 100 diameters of the orifice. The jet is rotated and reciprocated in the liner to ensure substantially complete coverage of the surface of the liner (or casing). It is also necessary to prevent damage to the liner or casing from occurring, due to the high pressure of the jetted liquid. This rotating and reciprocating is accomplished while the jet is simultaneously jetted against the liner to thereby clean the perforations of the casing or liner.

In order to facilitate the understanding of the present invention, the preferred embodiment of apparatus will be generally discussed from top to bottom in relation to FIG. 1. The apparatus of the present invention is hung above and in the well by means of traveling blocks 6 which are connected to a draw works (hoisting equipment; not shown). Suitable long links (holes) 7A and 7B connect the traveling blocks to the elevators 8. The links (bales) 7A, 7B are connected to a traveling block on the conventional hoist which is utilized to move the elevators up and down thereby raising or lowering the apparatus of the present invention. A high pressure pump 4 capable of maintaining a hydraulic horsepower in excess of 1,000 HHP (167 HHP per nozzle) is connected through a suitable conduit 5 to the high pressure rotating swivel 9 to provide a flow path for high pressure liquid 2 (which is stored in reservoir tank 1) into the tubing string 10 which forms a first flow path down the well.

In accordance with the invention then, a flow path for high pressure liquid is provided from the surface of the earth to a position in a well adjacent to a casing or liner having openings which are to be jet cleaned. High pressure liquid is jetted against such a casing or liner and the formation from a distance of up to approximately 12.5 inches for ⅛-inch nozzles or 100 nozzle diameters if a polymer additive is used, or 1.5 inches for ⅛-inch nozzles or 12 nozzle diameters if plain water is used. The effective cleaning radius of 100 diameters corresponds to an 80% energy loss. The same is true for the effective cleaning radius of 12 diameters, if plain water is used. When the standoff distance is reduced to less than 5 diameters the jet bodies are subject to undesirable erosion by splashback. A high pressure rotating swivel utilized on the tubing which forms the flow path for high pressure jet liquid permits rotation of the jetting string during jetting operations. This rotation is important to insure substantially complete coverage of the area to be cleared and to prevent damage to the liner or casing from occurring, due to the high pressure of the jetted liquid. The jetting string may also be reciprocated in the well during such operations and by combining a preplanned program of rotation and reciprocation substantially complete coverage of the casing or liner with the high pressure jet can be obtained.

The apparatus of the present invention will be discussed in greater detail with reference to FIGS. 2–4 and the various sections thereof. Briefly, FIGS. 2 and 3 show the jet tool; and FIG. 4 shows cleaning radius in accordance with the invention.

FIGS. 2 and 3 illustrate jet washing tool 17 in more detail. The jet tool 17 is positioned adjacent well casing 13 or liner 20 which has perforations 18 or slots 21, respectively, which need cleaning or adjacent geologic formation 19 which has perforations 18 which need cleaning. A tubular member 22 having its upper end connected to tubing string 10 extends the length of the jet tool 17. Three to nine jets 23 are connected to tubular member 22 and placed at 90° 120° phasing on the jet tool 17. The tubular member 22 has its upper end connected to tubing string 10 and continues to form annulus 25 with tubular member 22. The jets communicate with the interior of tubing member 26 and the annular space 25. The jets comprise a jet body 30 (or nozzle) having a central opening 27 of from 1/16th to ¼th inch diameter formed therein. The jet body 30 thus forms the orifice through which the jet is formed. A jet member 24 is matable with the jet body 30 by suitable means such as O-rings 28 and retaining rings 29. The jet seat member 24 may be constructed of carbide to resist erosion, and can consist of the same nozzles that are used in rotary bits. This permits a quick, economical access to various jet body sizes, as needed. The tubular members have axially aligned openings to receive the jet seat member 24. The jet seat members 24, serve the function of seating the jet bodies 30. The jet seat members 24, are also novel in the respect that this type of jet seat is readily available in the industry, as they are used in drill bits. Therefore, no new jet seat members need to be designed or manufactured. A jet body 30 has an exterior portion adapted to be mated with the jet seat members 24. The diameter of the jet as it leaves the tip of jet body 30 determines the standoff spacing of the jet. This is clearly shown in FIG. 4. Note that the standoff spacing B-B must be at least 5 times the distance A-A (central opening).

The preferred use of relatively large diameter jet orifices of ⅛th inch in the present invention is novel and is advantageous in that the effective cleaning radius of the apparatus is increased to approximately 12.5 inches for ⅛-inch nozzles or 100 nozzle diameters if a polymer additive is used, or 1.5 inches for ⅛-inch nozzles or 12 nozzle diameters if plain water is used (from 3.1 inches using a 1/32nd inch central opening with use of a polymer additive). Also, the larger sized jet orifices permit the removal of insoluble scale such as barium sulfate, strontium sulfate, or silicate. This larger sized jet body opening permits actual cleaning of the perforation tunnels in the adjacent geologic formation as well, whereas the prior art was limited to a far shorter cleaning radius. Current technology now provides an economic source of high pressure liquid that is able to provide a hydraulic horsepower of at least 1,000 HHP (167 HHP per nozzle) for supplying liquid at a flow rate of at least 4.6 barrels per minute if 6 nozzles as used (or 0.77 barrels per minute per nozzle) at pressures in excess of 5,000 psi. For example, pump trucks are widely used in routine downhole fracturing of a potentially productive geologic formation, and are able to generate the needed hydraulic horsepower, described above. Table I below indicates the effect of jet size on flow volume and standoff distance on power. It also illustrates the difference in fluid requirements to obtain the necessary jet velocities with different sized jets.

TABLE 1

EFFECT OF JET SIZE ON FLOW VOLUME AND JET STAND-OFF ON POWER LOSSES WITH A POLYMER ADDITIVE

| SIZE JET | GPM @ 7000 psi | FULL POWER (60 D) | ½ POWER (75 D) | 1/5 POWER (100 D) |
|---|---|---|---|---|
| 1/32" | 2.0 | 1.875" | 2.344" | 3.125" |
| ⅛" | 34.0 | 7.500" | 9.375" | 12.5" |

Table 2 below gives the performance of nozzles (or jet bodies) for various diameters. It can be seen that as the nozzle diameter is doubled that the hydraulic horsepower and flow rate must be increased by four-fold to maintain the same jet velocity and pressure drop. The nozzle discharge coefficient has an important effect on nozzle performance. The discharge coefficients observed under field conditions can range from 0.65 to 0.99 depending upon the nozzle design.

Table 3 below gives the performance characteristics of a well cleaning assembly over a practical operating range for six ⅛-inch nozzles. For this specific case the required hydraulic horsepower varies from 518 to 1126. The flow rate and jet velocity varies from 168 GPM (4.0 BPM) and 732 FPS to 218.4 GPM (5.2 BPM) and 952 FPS. Tables of this sort can be developed for ⅛-inch through ¼-inch nozzles. For ⅛-inch nozzles, 3 to 12 nozzles would cover the optimum operating range to keep the horsepower and friction to practical levels For ¼-inch nozzles, 2 to 3 nozzles would cover the optimum operating range. The number of ¼-inch nozzles used, is limited by symmetry about the tool axis. Therefore, a minimum of two ¼-inch nozzles must be used. Failure to maintain symmetry and a force balance about the tool axis would result in excessive tool drag during reciprocation and excessive torque during rotation. For 1/16-inch nozzles, 12 to 48 nozzles would cover the optimum operating range. The required hydraulic horsepower for 1/16-inch through ¼-inch nozzles range from 400 to 2000 hydraulic horsepower when variations in the number of nozzles and nozzle discharge coefficients are considered. A typical value for hydraulic horsepower requirements for most practical application is 1000 HHP.

TABLE 2

Pressure and Rate Requirements for Nozzles of Various Diameters*

| Nozzle Diameter (inches) | Nozzle Pressure Drop (psi) | Flow Rate (GPM) | Jet Velocity (FPS) | Hydraulic Horsepower per Nozzle |
|---|---|---|---|---|
| 1/32 | 7244 | 2.1 | 878 | 9 |
| 1/16 | 7244 | 8.4 | 878 | 36 |
| ⅛ | 7244 | 33.6 | 878 | 142 |
| ¼ | 7244 | 134.4 | 878 | 568 |

*Fluid specific gravity is 1.0, nozzle discharge coefficient 0.85.

TABLE 3

Performance of Six ⅛ inch Nozzles with Polymer at a Depth of 5000 feet with Tubing Having an Inside Diameter of 2.441 inches**

| Flow Rate (GPM) | Tubing Friction (psi) | Nozzles Pressure Drop (psi) | Tubing Surface Pressure (psi) | Surface Hydraulic Horsepower | Jet Velocity (fps) |
|---|---|---|---|---|---|
| 168 | 253 | 5030 | 5283 | 518 | 732 |
| 176.4 | 266 | 5546 | 5812 | 598 | 769 |
| 184.8 | 280 | 6087 | 6366 | 687 | 805 |
| 193.2 | 293 | 6653 | 6946 | 783 | 842 |
| 201.6 | 306 | 7244 | 7550 | 888 | 878 |
| 210 | 320 | 7860 | 8180 | 1002 | 915 |
| 218.4 | 333 | 7860 | 8835 | 1126 | 952 |

**Fluid specific gravity is 1.0, nozzle discharge coefficient 0.85

What is claimed is:

1. Apparatus for jet washing perforation tunnels in a well casing or liner positioned in a well and perforation tunnels in an adjacent geologic formation comprising a tubing means forming a well flow path from the earth's surface to a location adjacent to said well liner positioned in said well;

conduit means connecting a source of high pressure liquid to said tubing means, jet tool means having at least one hole in the wall thereof for jetting said high pressure liquid at said perforation tunnels in said well casing or liner, said jet tool means comprising a tubular member connected to the lower end of said tubing means;

a jet seat member fixedly connected to said tubular member, said jet seat member having a central opening aligned with said hole and a jet body having a central opening at least 3/23nd inch in diameter formed therein hydraulically sealed in said jet seat member, whereby said jet body may be rotated to provide axial movement of said jet body with respect to said jet seat member; and a source of high pressure liquid able to provide a hydraulic horsepower for supplying liquid at a flow rate of at least 0.77 barrels per minute per jet body used at pressures in excess of 5,000 psi, to wash said perforated tunnel to a standoff distance of at least 12 times the diameter of said central opening of said jet body.

2. Apparatus for jet washing perforation tunnels in a well casing or liner positioned in a well and perforation tunnels in an adjacent geologic formation comprising a tubing means forming a well flow path from the earth's surface to a location adjacent to said well liner positioned in said well;

conduit means connecting a source of high pressure liquid to said tubing means, jet tool means having a hole in the sidewall thereof for jetting said high pressure liquid at said perforation tunnels in said well casing or liner, said jet tool means comprising a tubular member connected to the lower end of said tubing means;

a jet seat member fixedly connected to said tubular member and having a central opening positioned over said hole;

means connecting said tubular member to said jet seat member and a jet body having a central opening at least 3/32nd to ¼th inch in diameter formed therein detachably engaged and hydraulically sealed in said jet seat member, whereby said jet body may be rotated to cause axial movement of said jet body with respect to said jet seat member; and a source of high pressure liquid able to provide a hydraulic horsepower for supplying liquid at a flow rate of at least 0.77 barrels per minute per jet body used, at pressures in excess of 5,000 psi, to wash said perforation tunnels to a standoff distance of at least 12 times the diameter of said central opening of said jet body.

* * * * *

UNITED STATES PATENT AND TRADEMARK OFFICE

CERTIFICATE OF CORRECTION

PATENT NO. : 5,060,725

DATED : October 29, 1991

INVENTOR(S) : R. Scot Buell

It is certified that error appears in the above-identified patent and that said Letters Patent is hereby corrected as shown below:

Claim 1, Col. 10, line 46: "3/23nd" should read --3/32nd--

Claim 1, Col. 10, Line 55: "perforated" should read --perforation--

Signed and Sealed this

Twenty-first Day of June, 1994

*Attest:*

*Attesting Officer*

BRUCE LEHMAN

*Commissioner of Patents and Trademarks*